United States Patent [19]

Byrne

[11] 4,153,246

[45] May 8, 1979

[54] SPORTS NET

[76] Inventor: Patrick J. Byrne, 854 Keystone Dr., Cleveland Heights, Ohio 44121

[21] Appl. No.: 818,395

[22] Filed: Jul. 25, 1977

[51] Int. Cl.[2] ..... A63B 69/00

[52] U.S. Cl. ..... 273/26 A; 273/29 A; 273/181 F; 160/89; 160/113; 160/119

[58] Field of Search ..... 273/127 R, 127 A, 127 B, 273/127 C, 127 D, 26 A, 29 B, 181 R, 181 F, 181 K, 181 A, 102 R, 102 S, 176 B, 176 D, 177 A, 177 B, 85, 86; D47/6 E; 248/17, 261, 317, 343, 262, 261, 266, 273; 211/180, 87; 160/319, 338

[56] References Cited

U.S. PATENT DOCUMENTS

| | | | |
|---|---|---|---|
| 982,360 | 1/1911 | Heaney et al. | 160/319 |
| 1,342,527 | 6/1920 | Cahill | 160/319 |
| 3,103,967 | 9/1963 | Gaschen | 160/113 |
| 3,539,869 | 1/1971 | Sicklesteel | 272/85 |

*Primary Examiner*—Richard T. Stouffer
*Assistant Examiner*—T. Brown
*Attorney, Agent, or Firm*—Fay & Sharpe

[57] ABSTRACT

This invention relates to a sports net and the mounting structure therefor which are of some height and width used for play or practice of golf, tennis, basketball, baseball or the like and secured to a one or two car garage and mounted in the garage above the top frame. The netting is of scrim, i.e., a coarse, open weave fabric on a plastic roller with a reel and axle support means for storing and lowering the netting. The sports net may be used in the garage for golf or tennis practice in inclement weather or out of doors with the garage door open. The mounting is between the lower edge of the raised garage door and the frame when the garage is raised.

5 Claims, 7 Drawing Figures

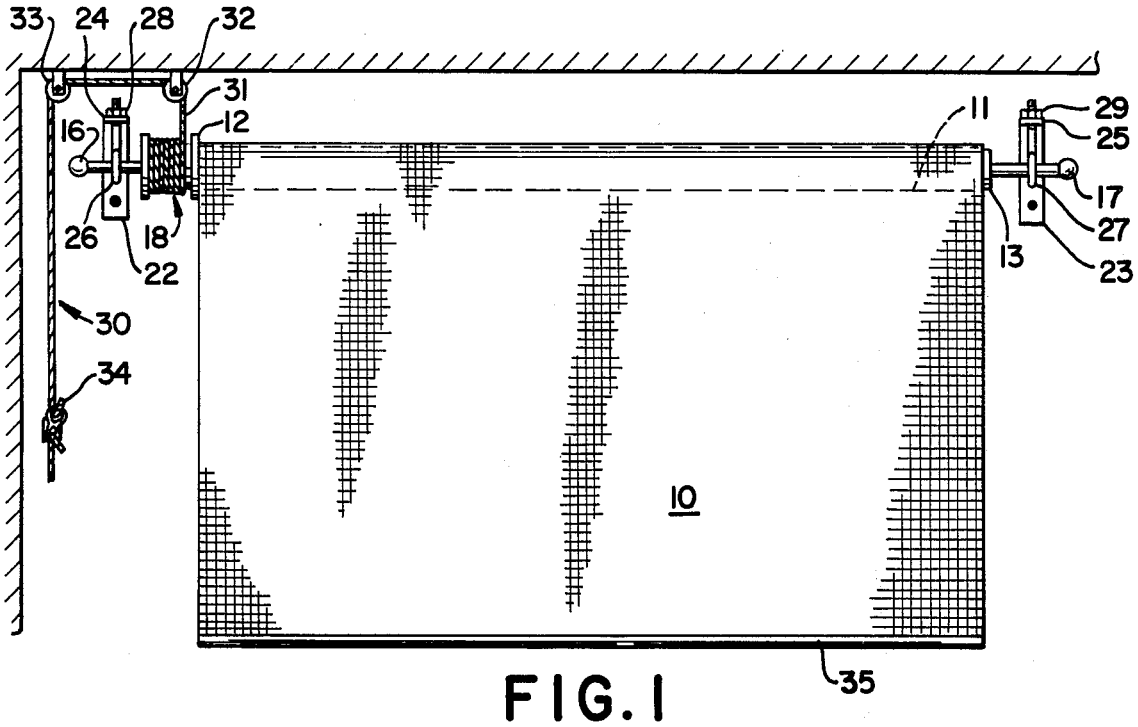
FIG. 1
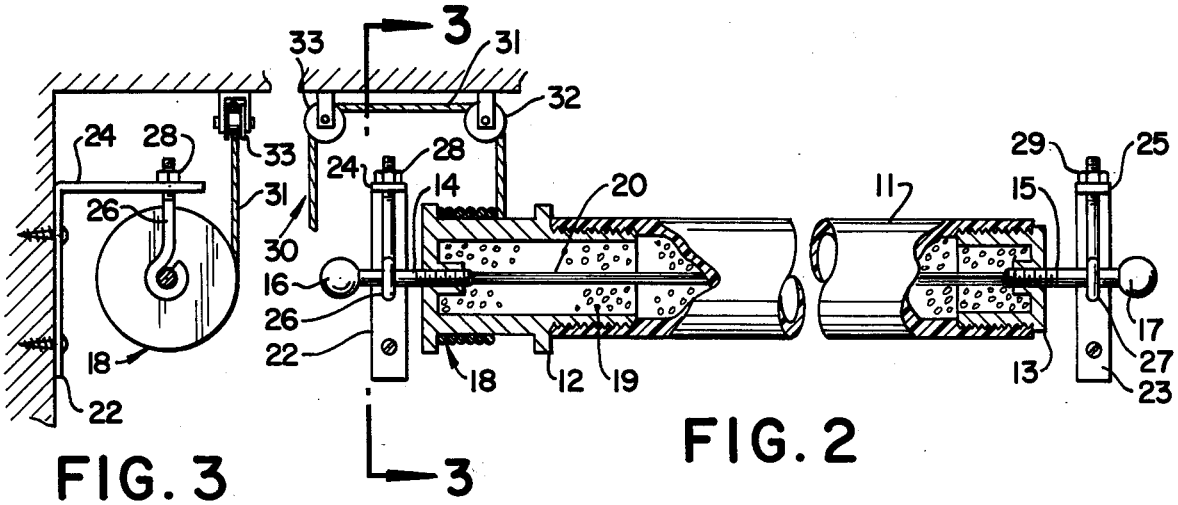
FIG. 3
FIG. 2
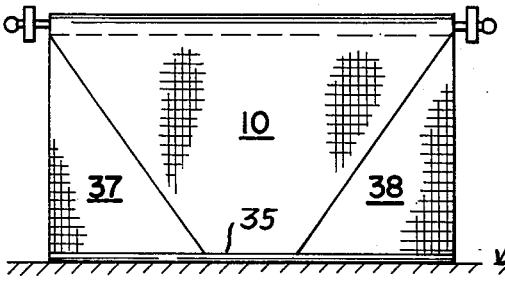
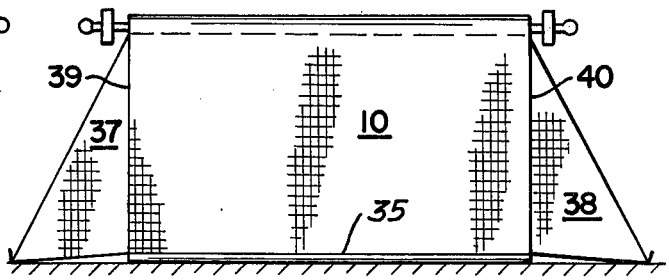
FIG. 4
FIG. 5

SPORTS NET

BACKGROUND OF THE INVENTION

1. Field of the Invention

The present invention relates to sports nets, and the mounting structure for an expanse of scrim possibly from 8 to 18 feet (2.4 m.–5.4 m.). It is intended that these would be mounted on a roller 2" to 4" in diameter (50 mm.–100 mm.), which would have a suitable reel for raising and lowering the sports net into position for usage. It might be lowered with the garage door up for a golf driving practice session on the concrete apron of the garage. Additionally, it might be the backstop for a tennis lesson, or alternatively for basketball or baseball backstops.

The idea behind the invention is to use the garage opening in a novel way to mount the sports net and do so inexpensively and with sufficient give to accept the stress of a ball being delivered to it at high velocity. Scrim is an excellent netting for said balls (golf, tennis or baseball) and the mounting structure is designed for flexibility.

Today these nets are hung from wire or framing for backstops or in gymnasiums. However, their permanency requires that they be stored and this is a problem. This new sports net is easily stored and mounted for ready use.

2. Summary of the Invention

The sports net extends for a width of 8 to 18 feet (2.4 m.–5.4 m.), and a depth of about 8 feet (2.4 m.). It is an open weave of scrim made of nylon or other high strength fiber in a soft color. It is rolled on a light tubing, preferably plastic, possibly fiberglass tubing 2" to 4" in diameter (50 mm.–100 mm.) with high density plastic end caps and a reinforcement of high tensile fiber in tension down the center of the tube which is filled with loose filler material to hold the tension fiber in the center of the tube. This produces a stiff roller which can take the impact of the ball stretching the scrim. On each end of the roller is an end cap and an axle adapted to be mounted for relatively limited longitudinal as well as rotational movement in an eye bolt structure which is a support or a bracket fastened to the studs above the garage door frame. The lower marginal edge of the scrim netting has a pipe or other weight to hold the scrim taut. Side restraints are optional.

BRIEF DESCRIPTION OF THE DRAWINGS

FIG. 1 is a schematic view of the sports net in lowered position;

FIG. 2 is a partial cross sectional view of the roller and mounting bracket therefor;

FIG. 3 is an end view along the line 3—3 of FIG. 1;

FIG. 4 is a view of a modification of the sports net showing wings in folded position;

FIG. 5 is a view of the same modification in FIG. 4 in extended position;

DESCRIPTION OF THE PREFERRED EMBODIMENTS

Figure 6:
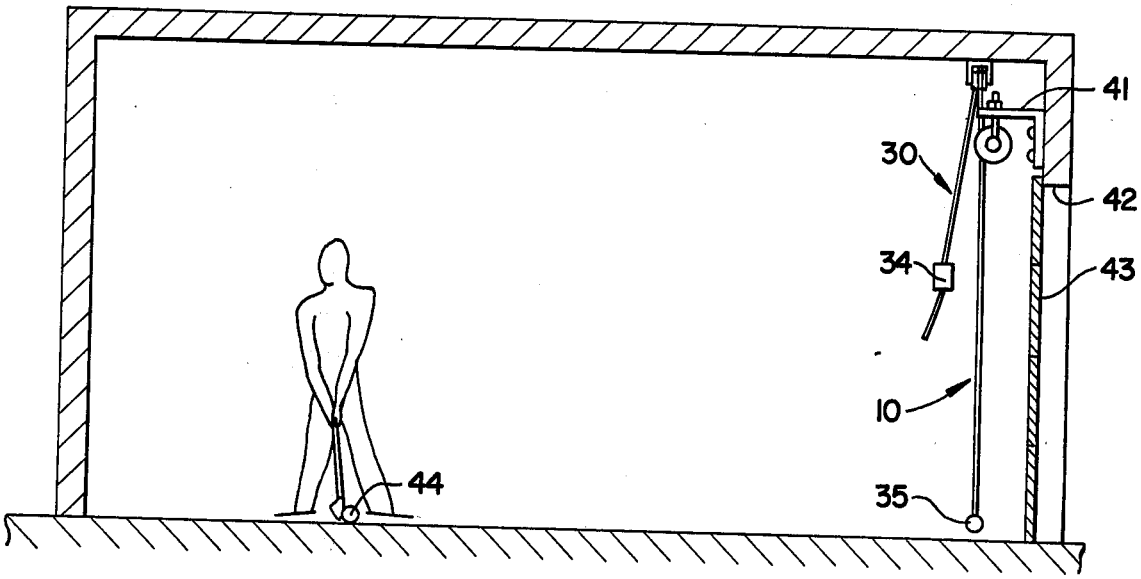
FIG. 6 is a view of the sports net down in a closed garage.

This invention relates to a sports net for a variety of sports adapted to be mounted in a garage for lowering to use position covering a major portion of the garage opening.

The material of the sports net shown generally at 10, is of scrim, a strong nylon open weave material. It is supported on a roller 11, having end caps 12 and 13 to which are secured axles 14 and 15 which are circular and of small diameter having an enlargement on each end at 16 and 17. One end of the roller 11 has a reel 18 combined with end cap 12 to lower and raise the scrim netting.

Within the roller would be loose fill material 19, such as foamed plastic which will center the high tension fiber 20 materials that hold the caps in tension rigidifying the structure which must be light but strong.

Mounting structure for the netting consists of angle brackets 22 and 23, having secured to the upper arms 24 and 25, an eye bolt 26 and 27, fastened by nuts 28 and 29 to support the axle for rotation and limited longitudinal movement under stress on the net.

To raise and lower the sports net, simple fastening means 30 generally consist of a rope 31, attached to the reel 18 by means of pulleys 32 and 33 to a rope fastener 34.

At the bottom of the net 10 is a weighted rod 35, which holds the net taut. For additional ball control, wings 37 and 38 may be added by securing the wings to the marginal edge of the net 10 at 39 and 40. Tie-downs would be required to hold the wings extended.

In use position, FIG. 6, a player would drive his golf ball against the net which is mounted at 41 inwardly of the door frame tope side 42. The door is shown closed at 43, FIG. 6, and in open position, FIG. 7. The sports net would be lowered by a weighted rod 35 and fastening means 30 which would be loosened, allowing the reel 18 to unwind and be retied to the rope fastener 34.

Figure 7:
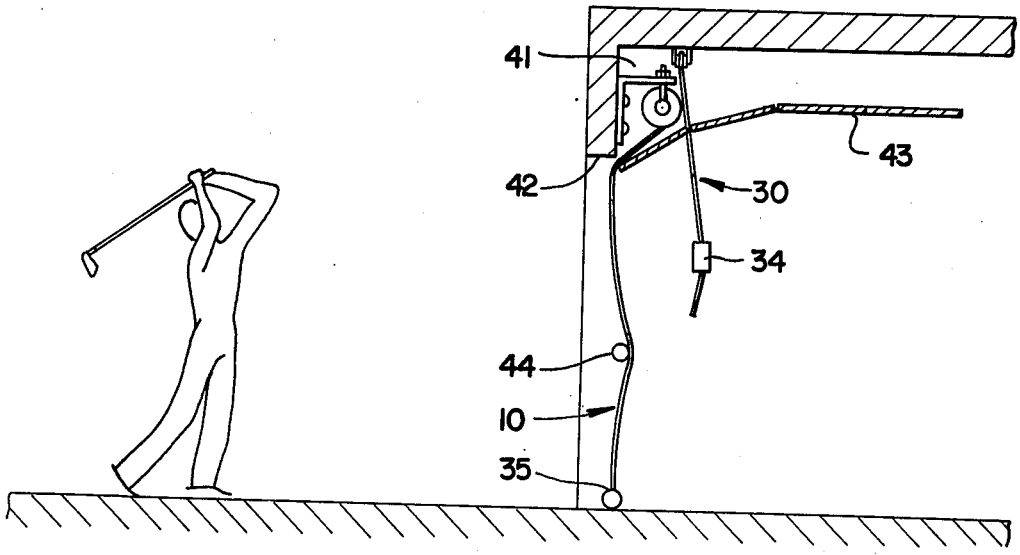
FIG. 7 is a view of the sports net being used for golf with the garage door open.

FIG. 7 shows a ball 44 hitting the net 10 with the rod 35 weighing down the net. In the event of heavy blows of a ball, the net will stretch and the roller may bend to accommodate the movement. The roller and its tube with its reinforcement provide a very lightweight but strong mounting structure. The eye bolt allows limited longitudinal movement as by bending or in rotation.

Having thus disclosed the broad concepts, what I claim is noted in the claims that follow which are the measure of the invention.

I claim:

1. A sports net and mounting structure thereof for use in connection with ball games such as golf, tennis, baseball, basketball and the like, comprising:

(a) an extensive main scrim-type netting;

(b) a roller for storing and supporting said netting under the stress of a ball projected thereagainst when said netting is supported in a vertical plane when in use;

(c) said roller comprising a rigid plastic tubing;

(d) filler material in said tubing for further rigidifying said roller;

(e) a high impact plastic material end cap attached at each end of said roller;

(f) a tensile material extending longitudinally through said roller and having opposite ends attached to a respective cap for further rigidifying said roller;

(g) means mounting said roller;

(h) said mounting means being fastened to a garage inwardly of a garage door which is vertically movable on roller tracks and a door opening for said door; said opening having side and top framing members, said mounting means being above the level of the top and side framing members, said mounting means further being above said garage door when said door is raised on said roller tracks, said roller tracks and mounting means allowing said sports net to be lowered when said garage door is closed or open, whereby when said garage door is open said net can pass between said top frame member and said door when said door is in its raised position; and (i) fastening means for holding said net in a stored position.

2. The apparatus of claim 1, wherein said netting is nylon.

3. The apparatus of claim 1, wherein said mounting means comprises a support bracket, each of said roller end caps has an axle projecting therefrom, and an eye bolt attached to said bracket and supporting said axle and roller for longitudinal and rotational movement.

4. The apparatus of claim 1, wherein a weighted rod is attached to the bottom of said netting.

5. The apparatus of claim 1, wherein triangular shaped netting wings are attached and extend outwardly and downwardly from the vertical sides of said main netting when in use, to control balls hit adjacent to said main netting.

* * * * *